US006961053B1

(12) United States Patent
Oguma

(10) Patent No.: US 6,961,053 B1
(45) Date of Patent: Nov. 1, 2005

(54) LCD DISPLAY DEVICE WITH DISPLAY DENSITY ADJUSTING FUNCTION

(75) Inventor: Koji Oguma, Tokyo (JP)

(73) Assignee: Tanita Corporation, Tokyo (JP)

( * ) Notice: Subject to any disclaimer, the term of this patent is extended or adjusted under 35 U.S.C. 154(b) by 0 days.

(21) Appl. No.: 09/433,389

(22) Filed: Nov. 3, 1999

Related U.S. Application Data

(63) Continuation of application No. PCT/JP99/01034, filed on Mar. 4, 1999.

(30) Foreign Application Priority Data

Mar. 10, 1998 (JP) ..... 10-075098

(51) Int. Cl.[7] ..... G09G 5/00
(52) U.S. Cl. ..... 345/204; 345/58; 345/87
(58) Field of Search ..... 345/101, 87, 86, 345/212, 214, 100, 204, 55, 56, 58

(56) References Cited

U.S. PATENT DOCUMENTS 4,196,432 A * 4/1980 Chihara ..... 345/96
4,469,449 A * 9/1984 Kato ..... 368/239
5,218,352 A * 6/1993 Endoh et al. ..... 340/765
5,515,074 A * 5/1996 Yamamoto ..... 345/101
5,805,121 A * 9/1998 Burgan et al. ..... 345/51
6,633,274 B1 * 10/2003 Yokota et al. ..... 345/100

FOREIGN PATENT DOCUMENTS

JP 1-213624 8/1989

* cited by examiner

*Primary Examiner*—Amr A. Awad
*Assistant Examiner*—Alecia D. Nelson
(74) *Attorney, Agent, or Firm*—McDermott Will & Emery LLP

(57) ABSTRACT

A LCD display device with display density adjusting function characterized by that, in an equipment which comprises a controller, a memory, a LCD drive unit of dynamic drive, a LCD, and an input device for distinguishing a using condition, a display density of said LCD having to be changed in response to the using condition thereof, said controller controls said LCD drive unit so as to be capable of inserting a time period ($T_0$) for outputting approximately same level of voltage to all common terminals and all segment terminals connected to the LCD into one frame period of LCD drive, and said controller selectively selects a value of time period ($T_0$) for outputting approximately same level of voltage to all common terminals and all segment terminals connected to said LCD based on information from said input device for distinguishing a using condition and adjusts a display density of the LCD.

5 Claims, 5 Drawing Sheets

LCD DISPLAY DEVICE WITH DISPLAY DENSITY ADJUSTING FUNCTION

This application is a Continuation of International Application No. PCT/JP99/01034, filed Mar. 4, 1999, which is incorporated herein by reference.

FIELD OF THE INVENTION

The present invention relates to a LCD display device whose display density is preferably adjustable.

BACKGROUND OF THE INVENTION

Since liquid crystal display element (hereafter, referred to as LCD) consumes rather small amount of current, and a large number of display pixels (hereafter, referred to as display segments) can be driven by a driving system called dynamic drive with a small number of terminals, said LCD is effective on down sizing and thereby has been used frequently in various fields. When a large amount of display segment is driven by a small number of terminals, however, LCD shows some drawbacks as:

① a visible angle for clear display is limited (see FIG. 1);

② when the drive voltage varies, density of display is made to vary also, which makes visibility rather difficult; and ③ depending on the temperature, density of display varies, which also makes visibility rather difficult.

If a large amount of terminals could be used to drive a large amount of display segments, these problems would not occur, but as a matter of fact it is rather difficult to make such packaging.

Though, in general, as countermeasures to solve these problems, a stabilized voltage is applied to a LCD drive unit to prevent variation of the drive voltage, and, on the other hand, when the density of display changes due to the variation of the visual angle or the temperature, the drive voltage is adjusted using volume knob so as to provide good visibility at that time, it is rather troublesome and inconvenient for a user to have to adjust every time when the using environment changes, and at the same time the number of components increases resulting in cost-increase (see FIGS. 2, 3, 4).

The object of the present invention is to provide LCD display device capable of always supplying fine LCD display suitable for its using condition without depending on a means for adjusting LCD drive voltage by volume knob and without significant cost increase.

DISCLOSURE OF THE INVENTION

According to a characteristic feature of the present invention, a using condition is detected and a time period ($T_0$) for adjusting a voltage difference between all common terminals and all segment terminals connected to the LCD to be equal or near to zero is inserted into one frame period of LCD drive so that the effective voltages of common terminals and segment terminals may be controlled to be voltages suitable for detected using condition.

According to an embodiment of the invention, a mechanism for detecting the using condition is provided such as: a voltage detector is added when the using voltage varies due to the battery or the like; a temperature detector is added by the use of temperature sensitive resistance when the temperature varies; the using condition is detected by the key operation when the visual angle varies depending on the using condition; and the density of display of the LCD is adjusted based on a signal from an input device by providing a key for density of display so as for the user to operate said key when the using condition is not obvious, and thereby, based on the stored or input information about conditions, the time period ($T_0$) for adjusting a voltage difference between all common terminals and all segment terminals connected to the LCD to be 0 V is provided and said time period ($T_0$) is made to be variable so that the effective voltage may be changed.

There will now be described the present invention in detail based on a preferred embodiment thereof with reference to the attached drawings.

PREFERRED EMBODIMENT OF THE PRESENT INVENTION

Figure 1:
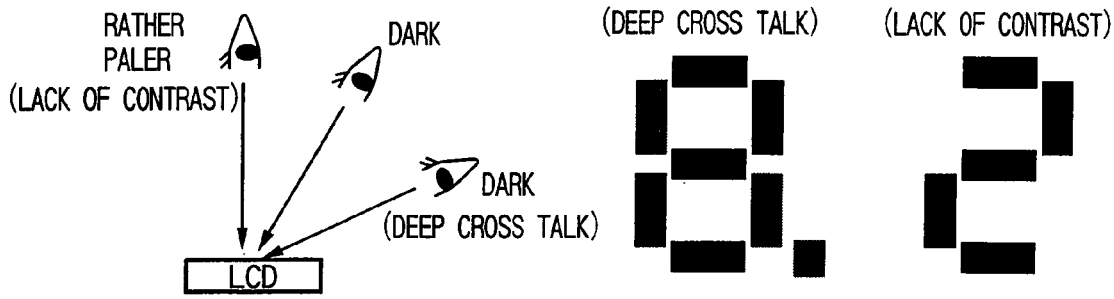
FIG. 1 is an explanatory drawing for illustrating visibility of the LCD display.
Figure 2:
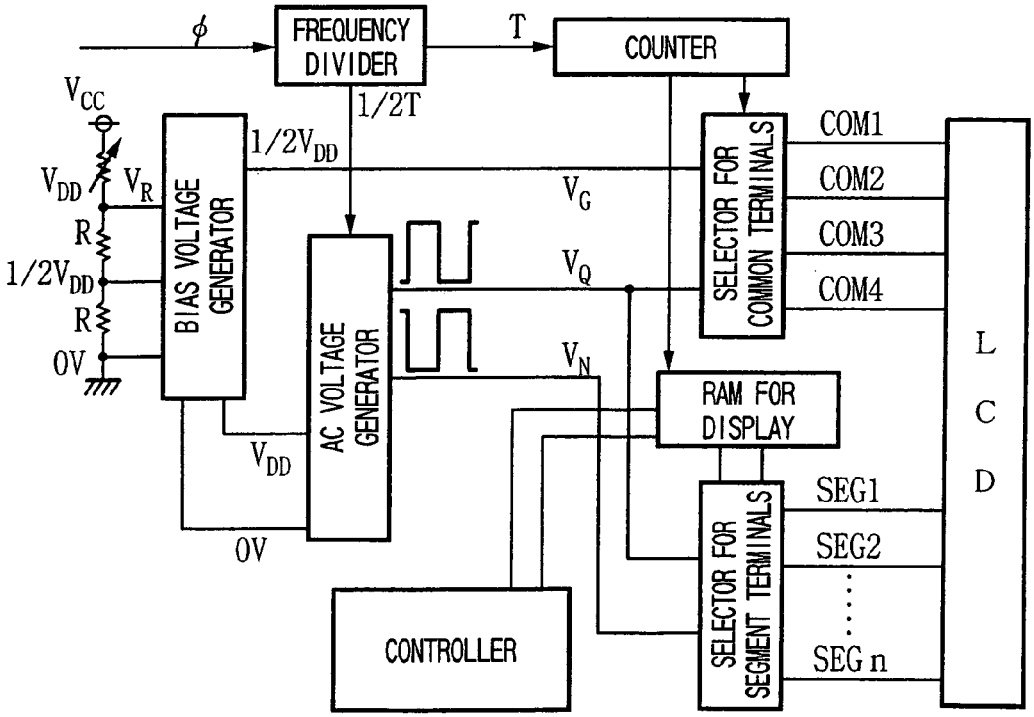
FIG. 2 (PRIOR ART)
FIG. 2 is a block diagram illustrating an example of the conventional LCD drive circuit.
Figure 3:
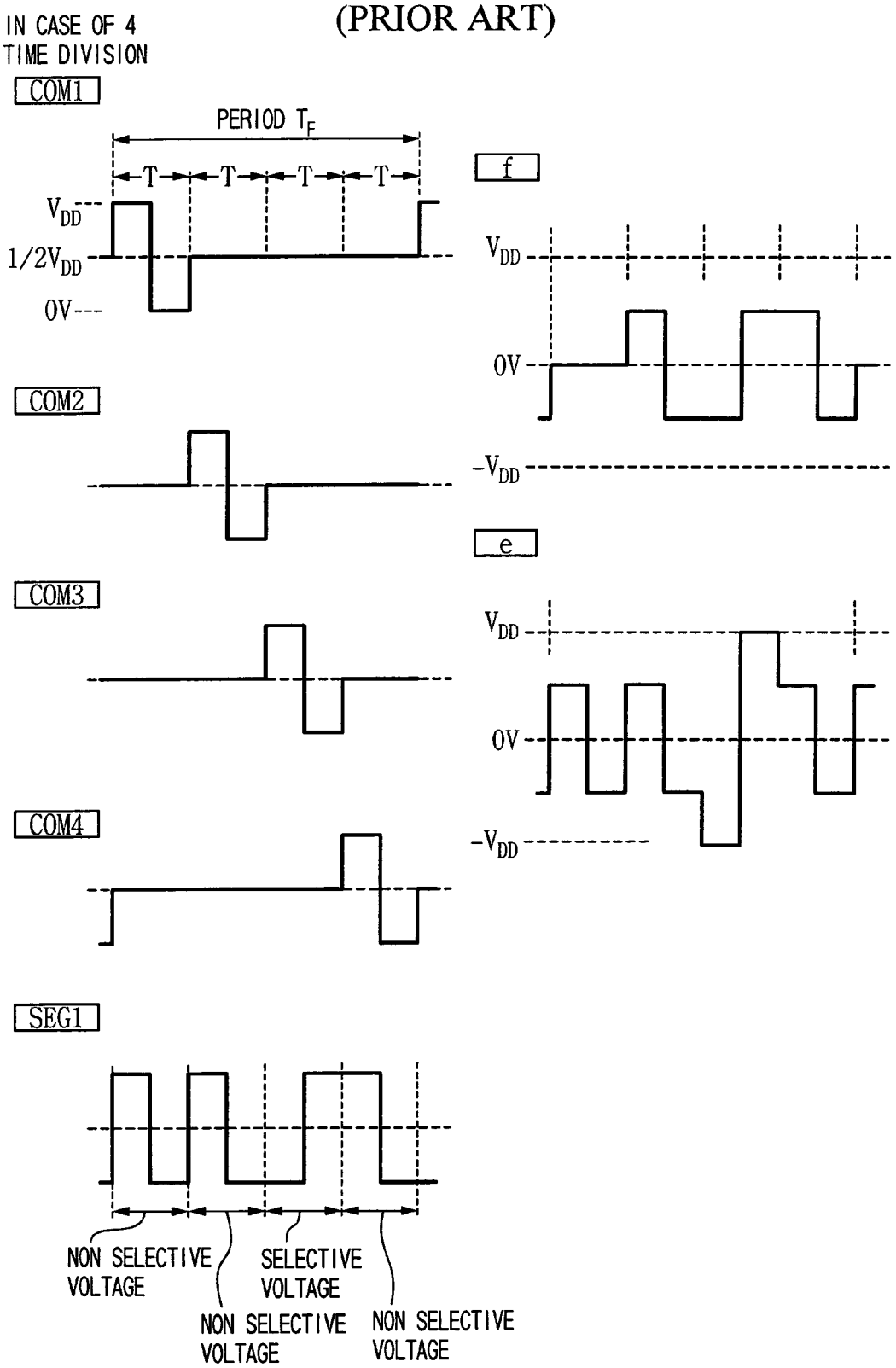
FIG. 3 (PRIOR ART)
FIG. 3 shows some examples of drive voltage waveform of the conventional LCD.
Figure 4:
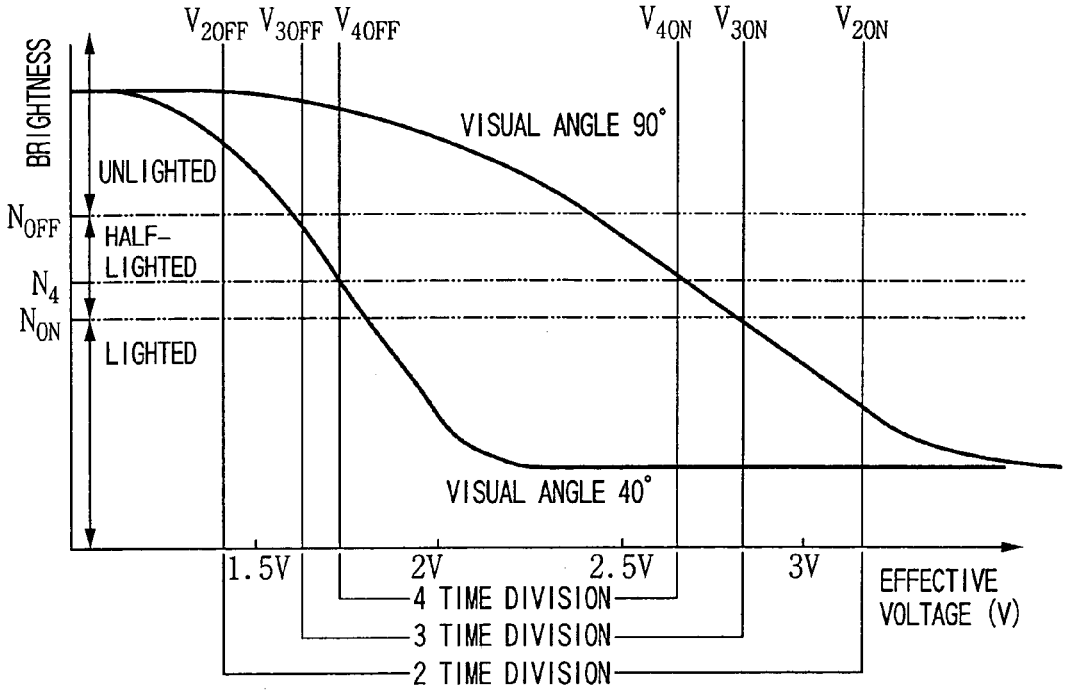
FIG. 4 is a general correlation diagram of brightness and effective voltage.
Figure 5:
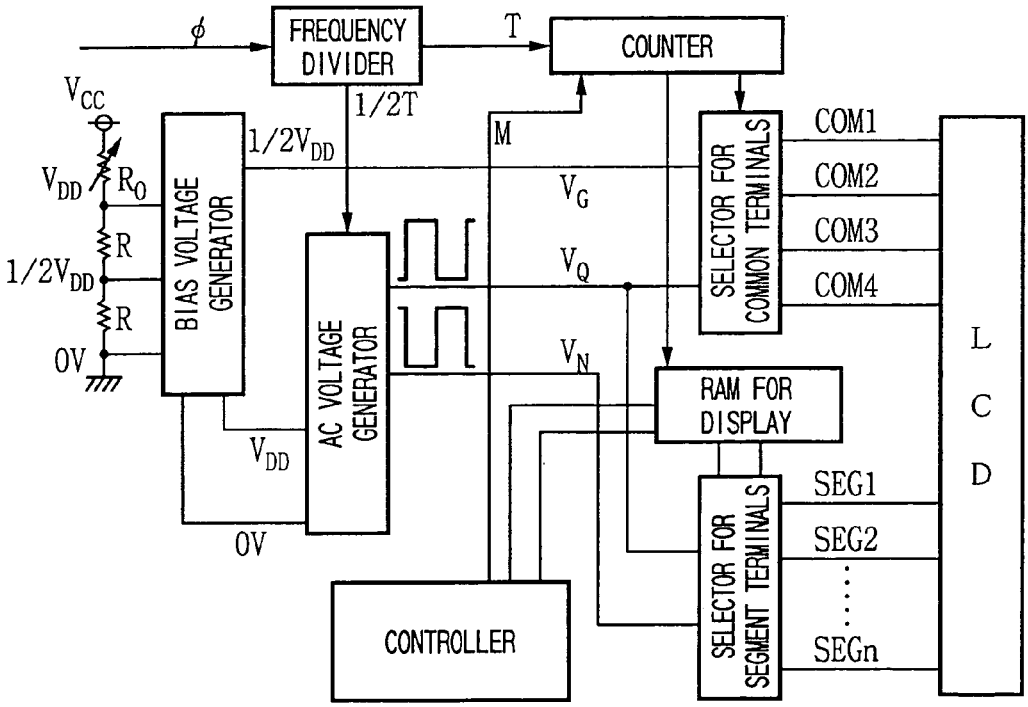
FIG. 5 is a block diagram illustrating a LCD drive circuit of an embodiment of the present invention.

FIG. 5 shows a block diagram of an embodiment of the invention, where a drive system is 1/2 bias 4 time division, T0=M*T and M is integer equal to or more than 0.

The difference of the present embodiment from the conventional 1/2 bias 4 time division is in only these point below:

① a counter counts, according to numerical value equal to or more than 0 given by a controller, from 0 to (3+M) repeatedly, and outputs the counted value; and ② when the numerical value given by the counter is equal to or more than 4, a selector for common terminal and a selector for segment terminal select and output $V_Q$ for all output terminals;

which means that what is required is quite a simple addition.

The controller calculates an optimum density value M for the current condition by a voltage detector and a key switch (not shown and outputs it to the counter.

The counter counts the number of times from 0 to (3+M) repeatedly every time when T is input.

The selector for common terminal selects and outputs $V_Q$, based on the output value from the counter, to COM1 if it is 0, to COM2 if it is 1, to COM3 if it is 2, or to COM 4 if it is 3. If it is equal to or more than 4, $V_Q$ is output to all COM terminals. In other case, $V_G$=1/2 $V_{DD}$ is output.

RAM for display outputs to the selector for segment terminal, based on the output value from the counter, a n-bit data corresponding to COM1 if it is 0, that corresponding to COM2 if it is 1, that corresponding to COM3 if it is 2, or that corresponding to COM 4 if it is 3. If the value is equal to or more than 4, all of the n-bit data is output as 0.

The selector for segment terminal outputs to the corresponding segment terminals, based on the n-bit data output from the RAM for display, $V_N$ if the bit is 1, and $V_Q$ if the bit is 0.

Figure 6:
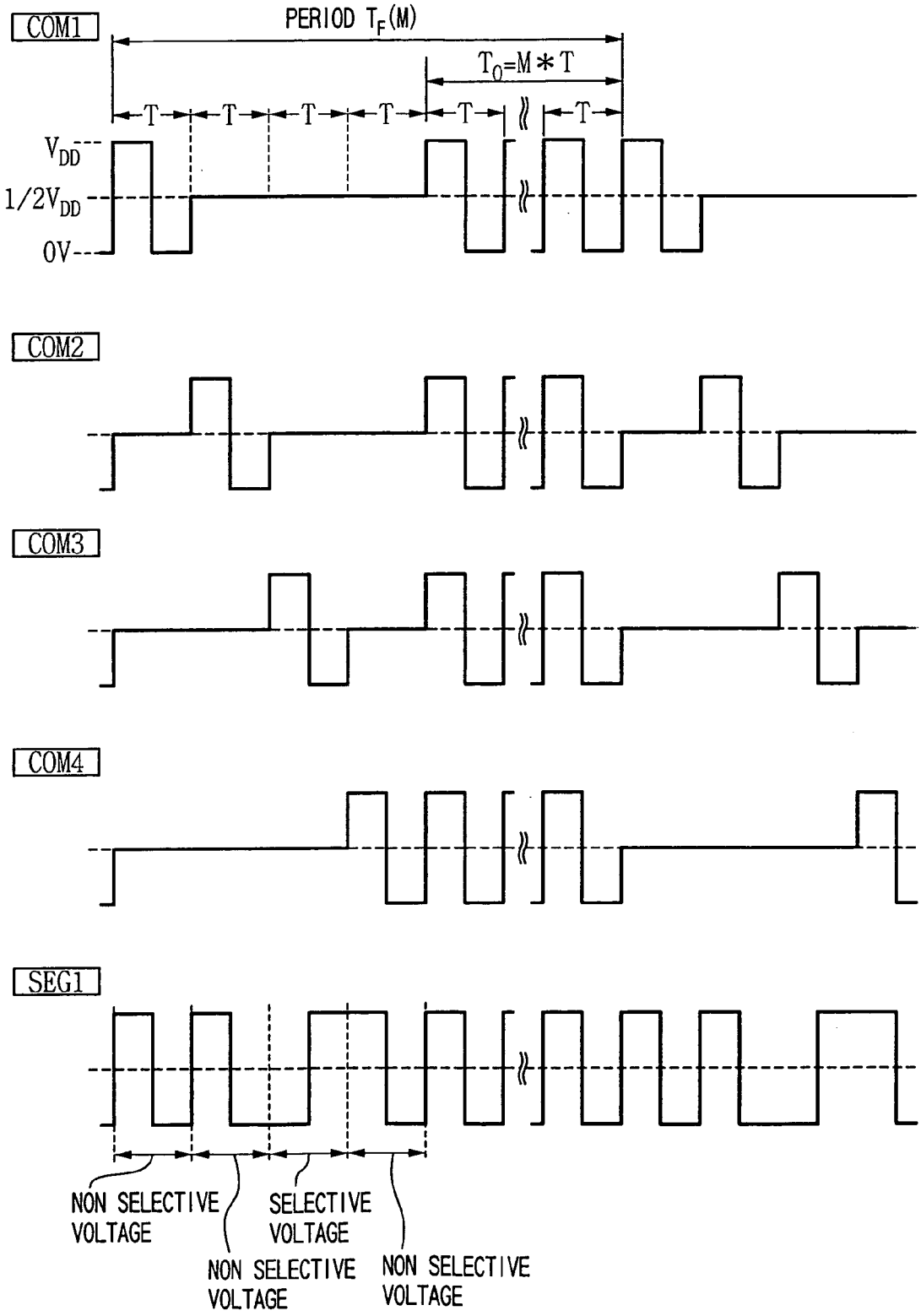
FIG. 6 shows LCD drive voltage waveforms of an embodiment of the present invention.
Figure 7:
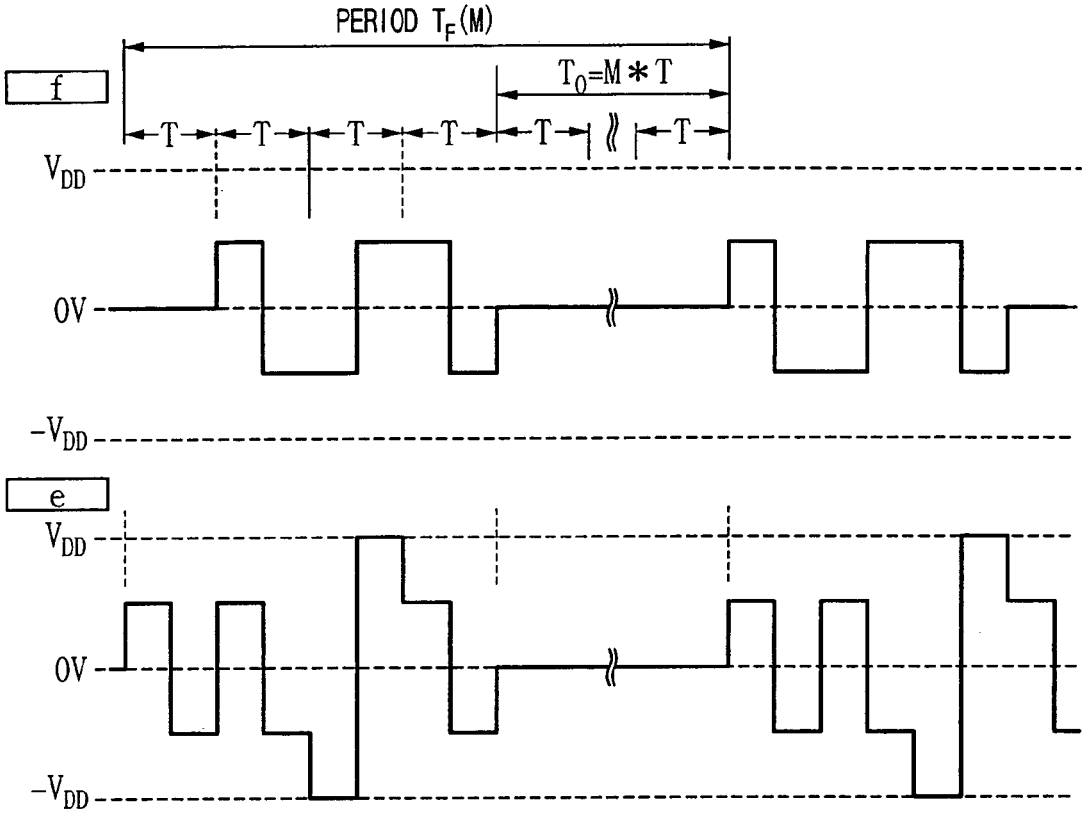
FIG. 7 also shows LCD drive voltage waveforms of an embodiment of the present invention.
Figure 8:
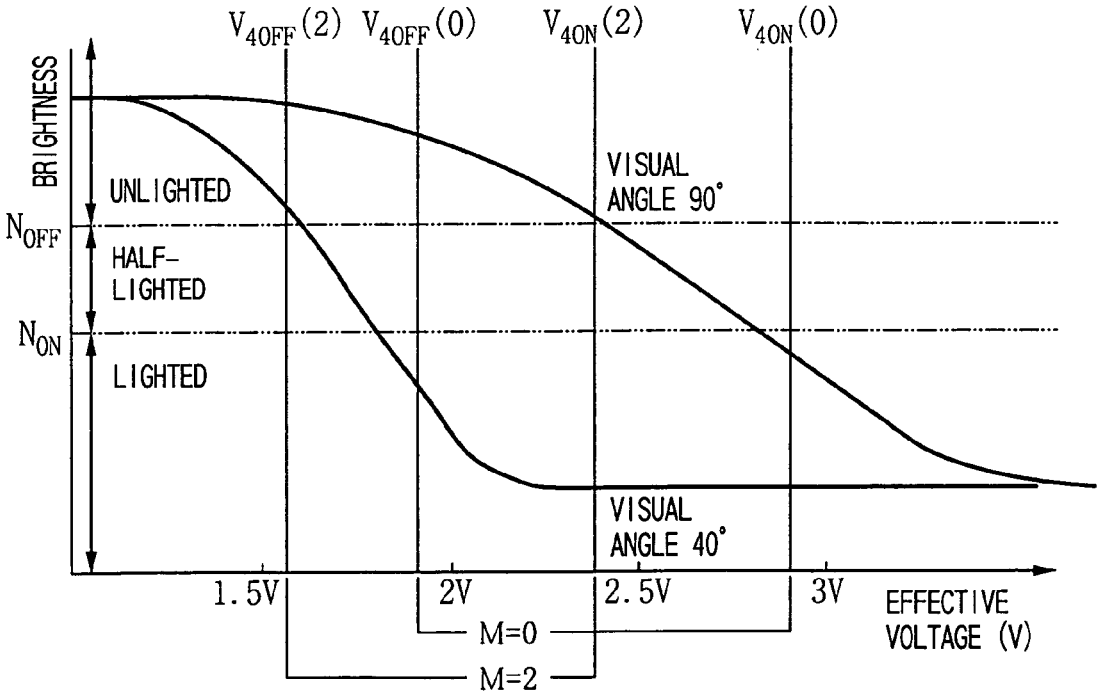
FIG. 8 is a correlation diagram of brightness and effective voltage of an embodiment of the present invention.

When the LCD drive unit described in the block diagram (FIG. 5) is employed, the outputs shown in FIGS. 6, 7 are obtained.

During the time period ($T_0$), the same voltage $V_Q$ is applied to all terminals. In case of $T_0$=M*T, the effective value of voltage $V_{OFF}$(M) applied to the unlighted segment (f) is calculated as:

$$V_{4OFF}(M)^2 = \{0^2T + 1/2V_{DD}^2 \times 3T/2 + (-1/2V_{DD})^2 \times 3T/2 + 0^2 \times MT\}/(4+M)T$$
$$= V_{DD}^2 \times 3/(16+4\cdot M)$$
$$V_{4OFF}(M) = (3/(16+4\cdot M))^{1/2} \times V_{DD}$$

The effective voltage $V_{4ON}$(M) applied to the lighted segment (e) is calculated as:

$$V_{4ON}(M)^2 = \{(-V_{DD})^2 \times T/2 + V_{DD}^2 \times T/2 + (1/2V_{DD})^2 \times 3 \times T/2 + (-1/2V_{DD})^2 \times 3 \times T/2 + 0^2 \times M \times T\}/(4+M)T$$
$$= V_{DD}^2 \times 7/(16+4\cdot M)$$
$$V_{4ON}(M) = (7/(16+4\cdot M))^{1/2} \times V_{DD}$$

In case of M=0, comparing above expressions with those for the typical 1/2 bias 4 time division of the "conventional example", they coincide with each other as:

$$V_{4OFF}(0)=(3/16)^{1/2}\times V_{DD}=V_{4OFF}$$

$$V_{4ON}(0)=(7/16)^{1/2}\times V_{DD}=V_{4ON}$$

That is, when M=0, the conditions is identical with those of conventional 1/2 bias 4 time division in which "the time period ($T_0$) which causes the voltage difference between all common terminals and all segment terminals connected to the LCD to be zero is not inserted".

Above expressions can be rewritten as follows:

$$V_{4OFF}(M)=(3/(16+4*M))^{1/2}\times V_{DD}=(3/16)^{1/2}\times(4/(4+M))^{1/2}\times V_{DD}=(3/16)^{1/2}\times V_{DD}'$$

$$V_{4ON}(M)=(3/(16+4*M))^{1/2}\times V_{DD}=(3/16)^{1/2}\times(4/(4+M))^{1/2}\times V_{DD}=(3/16)^{1/2}\times V_{DD}'$$

where, $$V_{DD}'=(4/(4+M)^{1/2}\times V_{DD}$$

That is, since an apparent drive voltage $V_{DD}'$ may be changed by changing M without changing $V_{DDl}$, the change of M provides the same effect as that caused by the change of $V_{DD}$. Therefore, it is proved that, according to the invention, LCD display may be held in optimum condition by adding quite a small logic portion without adjusting $V_{DD}$ by volume knob.

The case where the present invention is applied to an equipment in which VDD varies will be described as an example.

Above expressions may be rewritten as:

$$V_{DD}'^2=V_{DD}^2\times 4/(4+M)$$

$$M=4\times V_{DD}^2/V_{DD}'^2-4$$

In the equipment in which two pieces of single-4 type dry cells are used directly to supply LCD drive voltage, a lower limit voltage to guarantee an operation of the equipment is assumed to be 2V. The LCD is designed so as to provide fine display at $V_{DD}$=2V, and M=0. At that time, the apparent drive voltage is $V_{DD}'=V_{DD}$=2V since M=0.

When the cell is sufficiently charged, that is, when $V_{DD}$= 3V, M value for making the apparent drive voltage to be $V_{DD}'$= 2V is calculated as:

$$M=4\times 3^2/2^2-4=5$$

and thereby, when the time period for causing the voltage difference between all common terminals and all segment terminals to be zero during $T_0$=5T is inserted, the apparent drive voltage may be held as $V_{DD}'$32 2V and fine display may be maintained.

When the control device is designed so as to measure the voltage by the voltage detector while using the equipment, to calculate the M value by the use of above expressions, and to drive the LCD based thereon, the fine LCD display may be provided within the range down to the lower limit voltage to guarantee the operation even if the cell discharges. This is effective also on the weighing machine with body fat meter in which the visual angle varies widely depending on the using condition.

The liquid crystal material is arranged so that the same condition as that shown by the conventional example may be accomplished in which, when the LCD display being viewed from 40 degree of inclined direction, the effective value of voltage for reaching the brightness of $N_{OFF}$ is 1.6 V and that for NON is 1.8 V, and, when the LCD display being viewed from 90 degree of inclined direction, the effective value of voltage for reaching the brightness of $N_{OFF}$ is 2.4 V and that for $N_{ON}$ is 2.8 V.

It is assumed that $V_{DD}$=4.4 V, and, when the visual angle being 90 degree, it is assumed that M=0, and, when the visual angle being 40 degree, it is assumed that M=2.

For each case, unlighted outputs $V_{4OFF}$ (0), $V_{4ON}$ (0), $V_{4OFF}$ (2), $V_{4ON}$ (2) are calculated as follows:

| | |
|---|---|
| $V_{4OFF}$ (0) = 1.91 V | $V_{4ON}$ (0) = 2.91 V |
| $V_{4OFF}$ (2) = 1.56 V | $V_{4ON}$ (2) = 2.38 V |

When the visual angle is 40 degree, the brightness under the unlighted output $V_{4OFF}$ (2) is higher than $N_{OFF}$ and it is under unlighted condition. The brightness under the lighted output $V_{4ON}$ (2) is sufficiently lower than $N_{ON}$ and it is under lighted condition.

When the visual angle is 90 degree, the brightness under the unlighted output $V_{4OFF}$ (0) is sufficiently higher than $N_{OFF}$ and it is under unlighted condition. The brightness under the lighted output $V_{4ON}$ (0) is lower than $N_{ON}$ and it is under lighted condition. Therefore, when it is 4 time division, the fine LCD display capable of coping with wide visual angle may be accomplished by setting as M=0 or 2. This means that the fine LCD display may be accomplished while keeping the number of terminals of LCD and LCD drive unit to be small value. When the M value is increased, finer display with wider visual angle may be obtained.

In case where the invention is applied to the weighing machine with body fat meter, when the setting key is pushed, "setting mode" is employed and a person to be measured inputs his sex, year range, and height. Under "setting mode", the controller sets M=2 for the counter for LCD drive.

Thereby, under "setting mode", the finest display is provided for the visual angle of about 40 degree.

When the measuring key is pushed, "measuring mode" is employed in which a person to be measured takes standing posture and his weight and bio-impedance are measured. Under "measuring mode", the controller set M=0 for the counter for LCD drive. Thereby, under "measuring mode", the finest display is provided for the visual angle of about 90 degree.

Though it is set to M=2 in order to explain that wider visual angle is accomplished, M=1 may be sufficient since the visual angle in an actual "setting mode" is near to 60 degree.

Though the output voltages of all common and segment terminals during $T_0$ time period are represented by square wave AC voltage $V_Q$ for simple explanation, DC voltage, for example, $V_G$ (=1/2 $V_{DD}$), may be employed since the requirement is that the output voltages of the common and the segment terminals are identical.

Though it is set to $T_0$=M*T, unit time during $T_0$ time period may be "t" which is shorter than T. The shorter the "t" is, the more finely the length of $T_0$ time period may be set, and accordingly the apparent effective value of voltage, that is, the density of display, may be controlled more finely.

Though, in the present embodiment, the method for controlling the density of display by selecting either of "the state for always inserting the time period ($T_0$)" or "the state for always non-inserting the time period ($T_0$)" in 1 frame period $T_F$, another method may be employed in which N frame period is treated as 1 period and the state for the time period ($T_0$) to be inserted into only M frame periods among them is provided.

Since this allows the density of display which is between that in "the state for always inserting the time period ($T_0$)" and that in "the state for always non-inserting the time period ($T_0$)" to be formed artificially, the density of display can be adjusted more finely.

Though, in the embodiment, 4 time division is employed, it is a matter of course that better display quality may be accomplished when 3 time division or 2 time division is employed as a base.

In addition, since the basic principle is that the effective value of voltage is lowered relatively by inserting the time period for reducing the voltage applied to all segments to be zero, it is obvious that this principle is effective on not only 1/2 bias but also on 1/3 bias or 1/N bias.

Further, since it is not necessary that all common terminals and all segment terminals have the same voltage during $T_0$ time period but all the requirement is that the voltages applied to all terminal are lower, each of all common terminals and all segment terminals may have individual voltage respectively as long as the voltages applied to all segments are made lower within the range having non-negative effect on the display when the bias voltages is finely adjustable, for example, in case where N is large in 1/N bias.

As described above, the present invention provides the LCD drive unit which, in the equipment where the number of terminals of LCD is limited, may supply optimum density of display in response to the using condition without adjusting the drive voltage by volume knob or the like and with a little modification and with quite low cost.

In addition, since this unit allows to change the density of display with simple control, it can be easily controlled by the controller.

Though the density of the LCD display is usually turned paler to be indistinct when, in the equipment powered by the cell, the cell discharges and the LCD drive voltage lowers steeply, according to the present invention, it is easy to add the voltage detector and to attach the controller which adjusts the density of display automatically based on the detected data supplied from said voltage detector.

Further, in the weighing machine with body fat meter, since a person to be measured looks at the LCD typically from inclined direction when he set his personal data, the density of display is in cross talk condition and is too dark to be read. Since he is in standing posture and looks at the LCD from approximately vertical direction when his weight and impedance value are measured, the display turns paler and falls into lack of contrast.

According to the present invention, the density of display is easily controlled so that the fine display density may be provided for the inclined angle direction when the personal data is set, and also the fine display density may be provided for the vertical direction during measuring.

As described above, the LCD drive unit of the present invention has noticeable effect that the fine LCD display may be provided without troublesome operation such as user's volume adjusting and with small numbers of terminals and quite low cost.

What is claimed is:

1. A passive matrix type LCD display device capable of controlling the density of a visual presentation given in the form of a combination of selected segments, the display device comprising:

an LCD display comprising a predetermined segment arrangement having a plurality of common terminals connected to its individual segments and a similar counter segment arrangement having a plurality of segment terminals connected to its counter segment;

a two or more time-division dynamic LCD drive; and a dormancy determining controller;

wherein the dormancy determining controller supplies a controlled number M of AC drive voltage waves, M being an integer, each AC drive voltage wave having a period T, to add to a series of AC drive voltage waves each having a period T supplied from the two or more time-division dynamic LCD drive, the AC drive voltage waves being applied sequentially in time-division to all common terminals of the LCD display, the controlled number M varying to provide on the LCD display an image whose unclearness is reduced; and wherein the dormancy determining controller selects within a single frame period at least one predetermined dormant period $T_0$ during which the resulting voltage difference between all the common and segment terminals is zero.

2. An LCD display device according to claim 1, wherein the dormant period $T_0$ is equal to the controlled number M times the drive voltage period T, or the controlled number M times a predetermined period t shorter than the drive voltage period T.

3. A passive matrix type LCD display device according to claim 1, wherein the controlled number M varies with a surrounding temperature.

4. A passive matrix type LCD display device according to claim 1 or 3, wherein the controlled number M varies with a view angle at which a user looks at the LCD display.

5. A passive matrix type LCD display device according to claim 1, wherein the controlled number M varies with pieces of information representing different modes in which the LCD display device is used for particulars of a user.

* * * * *